US010105757B2

(12) United States Patent
Bruck

(10) Patent No.: US 10,105,757 B2
(45) Date of Patent: Oct. 23, 2018

(54) GRAIN GROWTH MANAGEMENT SYSTEM AND METHODS OF USING THE SAME

(71) Applicant: Siemens Energy Inc., Orlando, FL (US)

(72) Inventor: Gerald J. Bruck, Titusville, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 564 days.

(21) Appl. No.: 15/079,179

(22) Filed: Mar. 24, 2016

(65) Prior Publication Data

US 2017/0274450 A1 Sep. 28, 2017

(51) Int. Cl.
*B22C 9/06* (2006.01)
*B22D 27/04* (2006.01)

(52) U.S. Cl.
CPC ..... *B22D 27/045* (2013.01); *B22C 9/065* (2013.01)

(58) Field of Classification Search
CPC ..... B22C 9/065; B22D 27/045
See application file for complete search history.

(56) References Cited

U.S. PATENT DOCUMENTS 3,763,926 A * 10/1973 Tschinkel ..... C30B 11/003 164/126
6,666,254 B2 * 12/2003 Voigt ..... B22C 9/103 164/119
8,186,418 B2 * 5/2012 Liu ..... B22D 27/045 164/122.1

* cited by examiner

*Primary Examiner* — Kevin E Yoon

(57) ABSTRACT

System, methods for improving grain growth in a cast melt of a superalloy are provided. The system includes at least a mold having a shape defining a part of a turbo machine, e.g., a turbine blade. A cast melt, e.g., a superalloy, is poured into the mold, and one or more heating/cooling elements are arranged in the cast melt. The system further includes a controller operatively connected to the elements for controlling the electrical current of, e.g., a heating wire of the heating element, or controlling the flow-rate for, e.g., a coolant of the cooling element. By controlling, i.e., adjusting the current and/or flow-rate, via the controller, a temperature gradient may be induced to improve grain growth.

15 Claims, 4 Drawing Sheets

GRAIN GROWTH MANAGEMENT SYSTEM AND METHODS OF USING THE SAME

TECHNICAL FIELD

This present disclosure relates generally to superalloy casting practices, and more particularly, to methods of grain growth management during superalloy solidification.

BACKGROUND

Casting practices that dictate grain size and microstructure have significant affect on material properties such as strength and ductility. These same practices may also affect consistency and quality of the castings. Castings employed in gas turbines, for example, are either equiaxed, directionally solidified, or single crystal in nature. Many of these cast components require additional fabrication steps to achieve the final product.

Techniques associated with fine grain control during casting include, e.g., agitation to break up dendrites as they form, increase nucleation sites and inhibit grain growth; inoculation with compounds of lower melting point to increase nucleation sites and inhibit grain growth; and maintenance of low pouring temperature to promote fast freeing and inhibit grain growth. Unfortunately these techniques have particular drawbacks. For example, agitation can introduce microporosity and require post cast hot isostatic pressing to close pores. Inoculation can introduce non-metallic inclusions which can initiate fatigue cracks.

Additionally, and similarly to the above practices, maintaining low pouring temperature is also complex and relatively inflexible. For example, techniques associated with large directional or single crystal grain control may include very slow extractions, e.g., a few inches per hour, of the solidified part from the hot zone of a Bridgman vacuum furnace; also, pre-coating the alumina mold with a nucleation inhibitor to prevent lateral grain growth. Due to the complexity and inflexibility of the aforementioned practices, a need remains to improve management of grain growth during solidification.

SUMMARY

In one exemplary embodiment, a method of improving grain growth in a cast melt of a superalloy is provided. It should be appreciated that a superalloy melt is deposited, i.e., poured into a mold defining a shape for a turbomachine part, e.g., a turbine blade. In step one, and with the superalloy melt in the mold, the method includes the step of selectively arranging one or more refractory conduits in the superalloy melt. The refractory conduits may be a heating element and/or a cooling element.

In an embodiment where a refractory conduit heating element is arranged in the melt, the heating element may include a refractory outer sleeve encapsulating a heating wire. In an embodiment where a refractory conduit cooling element is arrange in the melt, the cooling element may include a refractory outer sleeve encapsulating a coolant. In the next step of the method, a temperature of the heating wire of the heating element or a flow-rate of the coolant of the cooling element may be adjusted to induce a temperature gradient in the superalloy melt. The adjustment may be made, e.g., via a controller operatively connected to the refractory conduits, i.e., the heating/cooling elements, and under the control of a control application.

BRIEF DESCRIPTION OF THE DRAWINGS

For a more complete understanding of the present disclosure, and the advantages thereof, reference is now made to the following descriptions taken in conjunction with the accompanying drawings, wherein like numbers designate like objects, and in which.

DETAILED DESCRIPTION

The components and materials described hereinafter as making up the various embodiments are intended to be illustrative and not restrictive. Many suitable components and materials that would perform the same or a similar function as the materials described herein are intended to be embraced within the scope of embodiments of the present invention.

In general, the computing systems and devices described herein may be assembled by a number of computing components and circuitry such as, for example, one or more processors (e.g., Intel®, AMD®, Samsung®) in communication with memory or other storage medium. The memory may be Random Access Memory (RAM), flashable or non-flashable Read Only Memory (ROM), hard disk drives, flash drives, or any other types of memory known to persons of ordinary skill in the art and having storing capabilities. The computing systems and devices may also utilize cloud computing technologies to facilitate several functions, e.g., storage capabilities, executing program instruction, etc. The computing systems and devices may further include one or more communication components such as, for example, one or more network interface cards (MC) or circuitry having analogous functionality, one or more one way or multi-directional ports (e.g., bi-directional auxiliary port, universal serial bus (USB) port, etc.), in addition to other hardware and software necessary to implement wired communication with other devices. The communication components may further include wireless transmitters, a receiver (or an integrated transceiver) that may be coupled to broadcasting hardware of the sorts to implement wireless communication within the system, for example, an infrared transceiver, Bluetooth transceiver, or any other wireless communication know to persons of ordinary skill in the art and useful for facilitating the transfer of information.

Figure 1:
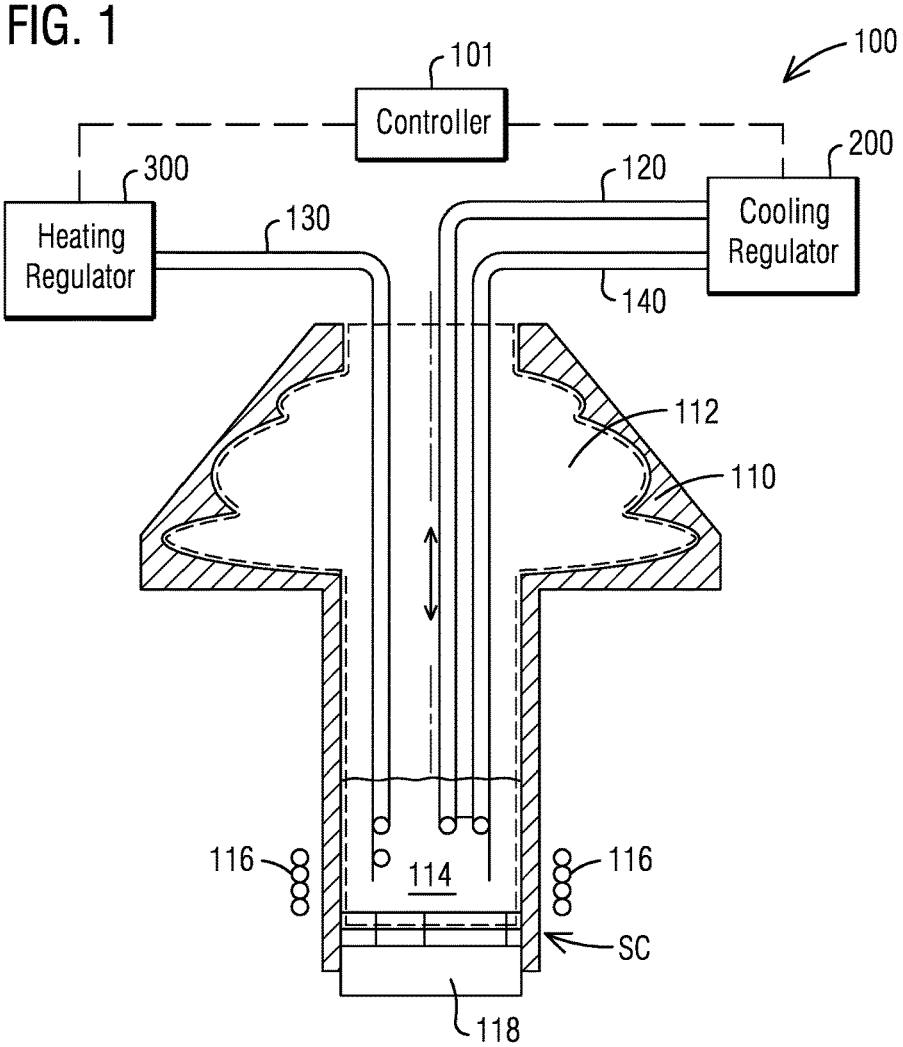
FIG. 1 is an exemplary schematic view of a system for grain growth management, in accordance with the disclosure provided herein.

Referring now to the drawings wherein the showings are for purposes of illustrating embodiments of the subject matter herein only and not for limiting the same, FIG. 1 illustrates a system 100 for managing grain growth in a superalloy melt for a turbomachine part during solidification.

As illustrated in FIGS. 1-5, the system 100 may include a controller 101 operatively connected to a cooling regulator 200 and/or a heating regulator 300 for controlling the direction of the grain growth. The cooling 200 and/or heating 300 regulators may be operatively connected to a crucible or casting mold 110 for facilitating the solidification process of, e.g., a part for a turbo machine, e.g., turbine wheels, blades, vanes, combustion nozzles, fuel swirlers, etc. As shown in FIG. 1, the mold 110 defines a shape 112, which in this embodiment corresponds to a blade for a turbomachine. The casting mold 110 may be ceramic, i.e., a ceramic crucible.

The controller 101 may be any general computing device comprising, e.g., a processing circuit operatively connected to a memory and/or storage device for executing one or more instructions and/or commands of a control application, which may be stored in the memory. It should be appreciated that the controller need not be positioned relative to the other components within the system, i.e., the controller may be in a remote location and operatively connected to any components and/or devices within the system via a wireless connection or wired connection.

A control application may also be provided and stored, e.g., within the memory or other storage medium operatively connected to the controller. The control application may comprise of a plurality of instructions or programming logics, which is executed by the controller processing circuit, and causes one or more components and/or devices within or operably connected to the system to perform a desired function. Examples of the various instructions may include, process control instructions for controlling the flow rate, e.g., of a coolant, or the current to, e.g., a heating element, to change its temperature, via the respective cooling 200 and heating 300 regulators.

The system 100 may further include a superalloy 114 which may be deposited or poured into a region of the mold 110 where grains may be grown, e.g., via one or more methods as described herein. Types of superalloys 114 may be, e.g., nickel based superalloys such as CM247, Rene (e.g., Rene 80, Rene N4), CMSX (e.g., CMSX 4, CMSX 10), IN (e.g. IN 738, IN 939), cobalt based superalloys such as X-40, MAR-M 509, MAR-M 918, iron based or iron-nickel based superalloys such as A286, Incoloy 903 and Incoloy 909, and other superalloys known to persons of ordinary skill and depending on the application and/or the turbomachine part being solidified.

A pyrometer (not shown) may further be included in the system 100 and operatively configured to monitor one or more conditions in or at the mold 110, e.g., the superalloy 114, to aid in the process control function, e.g., by transmitting/providing diagnostic information, such as melt temperature, to the system 100, or more particularly, the controller for use by the control application to control flow rate and/or electrical current. It should be appreciated that alternative or additional instruments for measuring high temperatures may be use in the system 100 for providing diagnostic information. For example, additional or alternate sensors, such as sonic depth gages, may be included in the system 100 for measuring growth rate and direction of a solidified interface, and providing this solidification diagnostics to, e.g., the controller 101. In this embodiment, the controller 101 may use the solidification diagnostics to, e.g., adjust flow rate and/or current as described herein, and for optimized management of grain growth.

With continued reference to the figures, one or more hot zones 116, e.g., a hot zone furnace 116, may be provided in the system 100 and positioned relative or adjacent to the mold 110, e.g., on an outer portion of the mold 110 and generally surrounding the molten material to control solidification and for promoting maximum temperature gradient along an axis of the turbomachine part. Alternatively or additionally, one or more heating zones may surround the entire path of solidification to promote maximum temperature gradient. In yet a further embodiment, the system 10 may include one or more cold zones or chill blocks 118, which may also promote maximum temperature gradient along the axis of the turbomachine part. The chill block 118 may be provided at the lower portion of the mold 110. For example, FIG. 1 shows the chill block 118 arranged relative to one or more seed crystals SC beneath the superalloy 114. It should be appreciated that the controller 100 may be operatively connected to one or more of the hot zones 116 and cold zones 118 for controlling their operation and to promote maximum temperature gradient along the axis of the turbomachine part.

With continued reference to the figures, the system 100 may further include one or more conduits 120. The conduits 120 may be selectively deposited in the superalloy 114 in a random or uniform manner, e.g., axially, to promote directional grain growth during solidification. The conduits 120 may comprise an outer sleeve at least partially encapsulating cooling and/or heating materials therebetween. The outer sleeve may be comprised of refractory materials of good thermal conductivity as the refractory conduits 120 are moved throughout the superalloy 114 to manage heat distribution and temperature gradient. In one embodiment, alumina may be a good refractory material given its thermal conductivity properties. In this embodiment, e.g., the outer sleeve may comprise alumina or the refractory conduit 120 may be an alumina tube. During operation, thermal conductivity of cast nickel based superalloys ranges from about 10 to 15 W/m° K. Alumina tubing of high density, e.g., 99.5%, may have a thermal conductivity of approximate 30 W/m° K which, given the thermal conductivity of cast nickel based superalloys, provides good thermal conductivity.

Other refractory materials may include, e.g., mullite, zirconia or zirconia partially stabilized with magnesia, or yttria, demonstrating a thermal conductivity, e.g., of about 2 to 4 W/m° K. Silica tubes may also be used as a refractory materials, and demonstrates a thermal conductivity, e.g., of about 1.4 W/m° K. Additionally, other high temperature oxides such as CaO, $Cr_2O_3$, $La_2O_3$ $CeO_2$ and $ThO_2$ (mp 6130° C.) may be manufactured in tubular form or coated over, e.g., resistance heating wires or other materials used for heating and/or cooling elements as described herein and known in the art.

Figure 2:
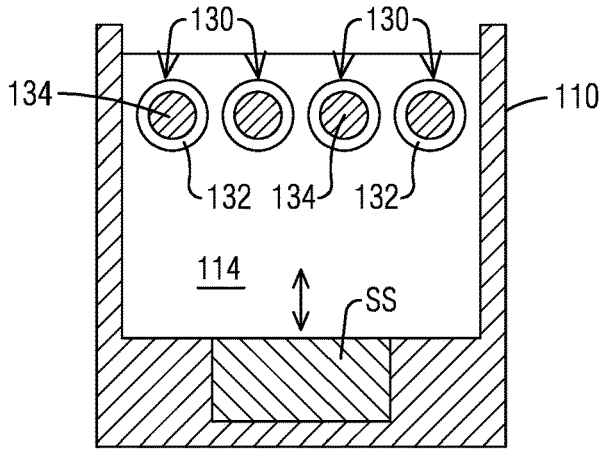
FIG. 2 is an exemplary schematic view of a refractory conduit of cooling elements positioned in a cast melt to enhance vertical grain growth, in accordance with the disclosure provided herein.
Figure 4:
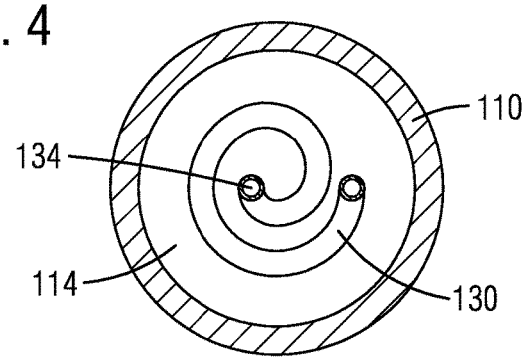
FIG. 4 is an exemplary cross-sectional view of a mold in the system of FIG. 3, and in accordance with the disclosure provided herein.

With continued reference to the figures and now to FIGS. 2 and 4, in one exemplary embodiment, the refractory conduits 120 operatively connected to the cooling regulator 200 may be refractory conduits of cooling elements (COC) 130. Similar to the refractory conduit 120, the COC 130 includes an outer sleeve 132 adapted to encapsulate a coolant 134. The outer sleeve 132 may be similar to the outer sleeve for the refractory conduit 120 described herein. For example, the COC 130 may be an alumina tube having the coolant 134 circulating therethrough. In one exemplary embodiment, the coolant 134 may be sodium potassium. Sodium potassium, e.g., at a weight percent of 23Na and 77k, is liquid at temperatures up to 785° C. Circulating sodium potassium through the alumina tubing 132 at 700° C. may cause the superalloy 114, e.g., at approximately 1300° C. to cool, which may induce a temperature gradient. During the solidification process, e.g., grains tend to grow in the direction of maximum temperature gradient as enhanced by the location of the COC 130, which is shown in FIG. 2 above the solidified superalloy SS. Alternatively or additionally, fluids such as water (or steam), mercury, and other metals or metallic alloys, such as gallium or indium alloys, may be used as a coolant 134, in addition to other materials known in the art for having a good capacity to absorb heat and be capable of being, e.g., pumped and circulated through the outer sleeve 132 of the COC 130. In yet a further exemplary embodiment, solid state devices, e.g., based on Peltier effect cooling, may also be used with or as an alternative to fluid cooling.

To enhance the direction of grain growth, e.g., as shown in FIG. 2, a plurality of COCs 130 may be selectively arranged or positioned in the superalloy melt 114. It should be appreciated that the arrangement may be a horizontal or vertical arrangement. FIG. 2 illustrates the horizontal arrangement of a plurality of COCs 130, with at least one of the COCs 130 circulating the coolant 134 at 700° C. The temperatures and flow rates of the coolants 134 in one or more of the COCs 130 may be adjusted, e.g., via the controller, to control the direction and speed of solidification. It should be appreciated that the coolant 134 temperatures of the COCs 130 may be controlled or adjusted individually or as a group, prior to being deposited, circulated, or while moving throughout the superalloy 114.

Figure 3:
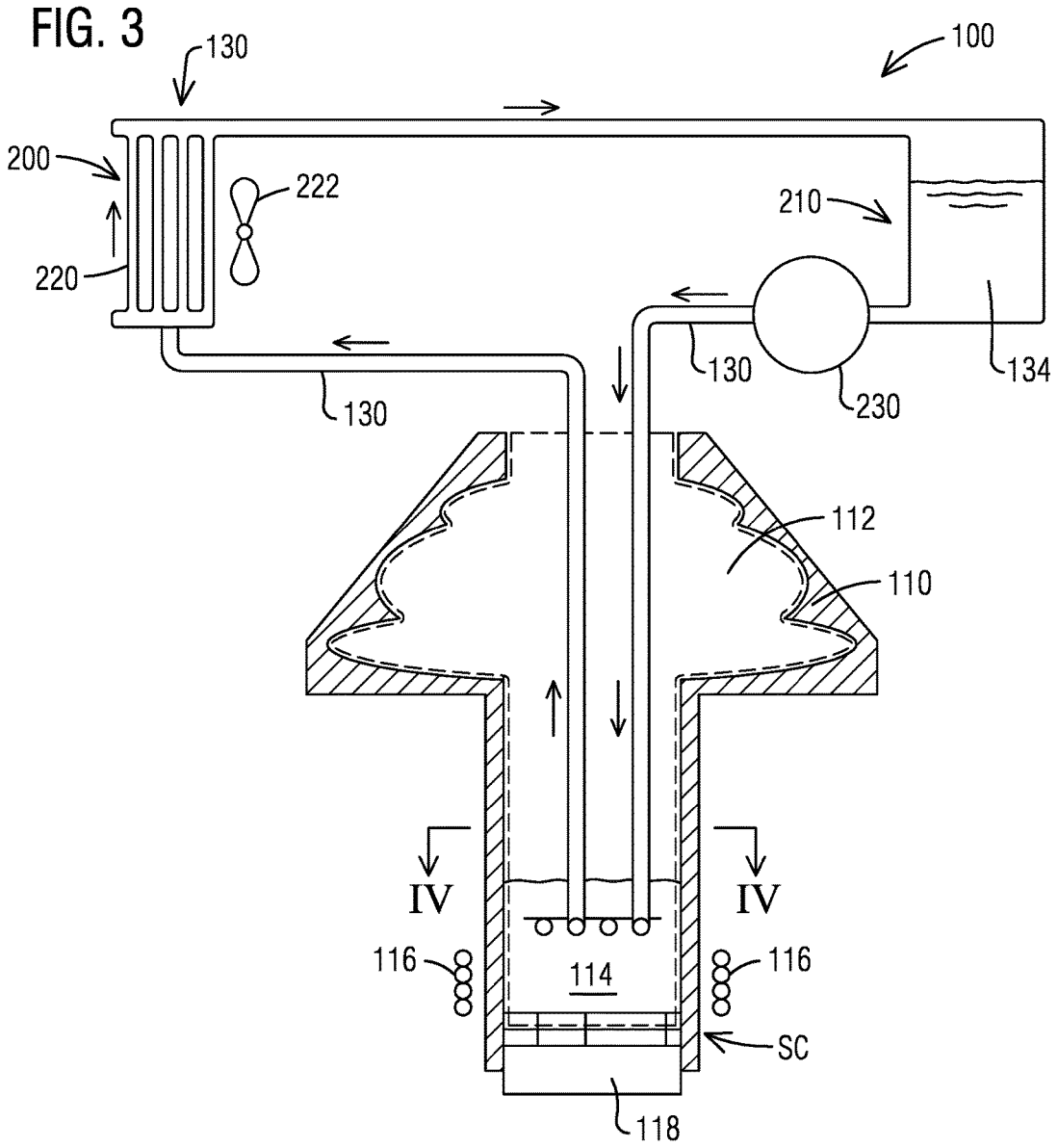
FIG. 3 is an exemplary schematic view of a further embodiment of the system of FIG. 1, in accordance with the disclosure provided herein.

With reference now to FIG. 3, the cooling regulator 200 may be operatively connected to one or more of the COC 130 for controlling the temperature and/or flow rate of the coolant 134 as it is circulated through the COC 130. In one exemplary embodiment, the cooling regulator 200 may include a reservoir 210 operatively connected to a heat exchanger 220 and a pump 230. The reservoir 210 may be provided as a container for holing and/or storing the coolant 134 to be circulated through the COC 130. In this exemplary embodiment, the controller 101, e.g., under the control of the control application, may be operatively connected to the pump 230, and configured to pump or supply the coolant 134 from the reservoir 210 and through the COC 130.

During the solidification operation, the coolant 134 circulated through the COC 130 in the melt 114 may increase in temperature, i.e., pick up heat from the melt 114 as a result of the melt temperature being higher than the coolant 134 being circulated, which would require that the coolant 134 be cooled before it is returned to the reservoir 210. In an exemplary embodiment, to return the coolant 134 to its initial temperature, e.g., the coolant 134 may continue to flow through the COC 130 in the melt 114 and into the heat exchanger 220, which may be operably configured to recover the temperature of the coolant 134 prior to returning the coolant 134 to the reservoir 210. To return the coolant 134 to or approximate to its initial temperature, the heat exchange 220 may include a fan 222, or similar device known to persons of ordinary skill, operable to cool the coolant from the COC 130. It should further be appreciated that the controller 101 may be operatively connected to the components of the cooling regulator 200 for controlling the cooling functionality, via the control application, to recover the temperature of the coolant 134.

Figure 5:
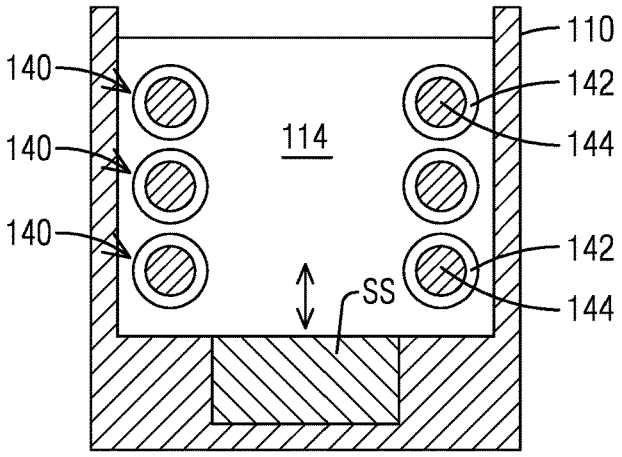
FIG. 5 is an exemplary schematic view of a refractory conduit of heating elements positioned in a cast melt to enhance vertical grain growth, in accordance with the disclosure provided herein.
Figure 7:
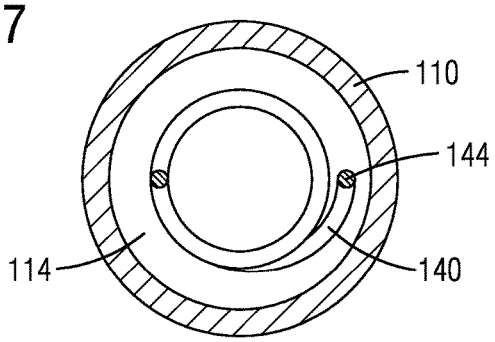
FIG. 7 is an exemplary cross-sectional view of a mold in the system of FIG. 6, in accordance with the disclosure provided herein.

With continued reference to the figures and now FIGS. 5 and 7, in yet another exemplary embodiment, the one or more of the refractory conduits 120 may be refractory conduits of heating elements (COH) 140. The COH 140 may be similar to the refractory conduit 120 and COC 130. As shown in FIG. 5, the COH 140 may include an outer sleeve 142, which may be similar to the outer sleeve 132, in that it comprises refractory materials and is adapted to encapsulate a heating element 144, e.g., a heating wire.

The heating wire 144 may be a high electrical resistance and high melting point heating wire 144 position within, e.g., the alumina tubing 142. In one embodiment, the high electrical resistance and high melting point heating wire 144 may be Tungsten, which, e.g., may be electrically resistance heated up to 3000° C. without melting. In this embodiment, and during the solidification process, the tungsten 144 encapsulated within the outer sleeve 142 may be heated, via the controller 101, to a temperature above the melt temperature of the superalloy 114, e.g., to about 1200-1400° C. for a cast nickel based superalloy, but below the melting temperature of the outer sleeve 142, e.g., below about 2072° C., the melting temperature of an alumina sleeve to control the direction and speed of solidification.

Alternatively or additionally to tungsten, the heating element 144 may be or be comprise of resistance heated metals and metallic alloys like Kanthal (FeCrAl alloy), Nichrome (80Ni20Cr), platinum, molybdenum and cupronickel (CuNi alloys). Intermetallic materials, such as molybdenum disilicide ($MoSi_2$) with melting point of 2030° C., are also electrically conductive and may represent a candidate for the heating element 144. Alternatively or additionally, certain ceramics such as silicon carbide, barium titanate or lead titanate may also be used in or as the heating element 144. It should be appreciated that any combination of the above resistance heated wires may be used with or without refractory sleeve materials as they have a very high melting temperature relative to the casting alloy 114. In yet a further embodiment, and to the extent that a non-conductive oxide may form on the surface of the above heating wires 144, such heating wires 144 could be electrically insulated by the non-conductive oxide from the melt 114.

With continued reference to the figures, and in a further embodiment, a plurality of COH 140 may be selectively deposited and positioned within the superalloy 114, e.g., in a horizontal or vertical arrangement, e.g., the vertical arrangement of FIG. 5, to further promote maximum temperature gradient and to control the direction of grain growth.

Figure 6:
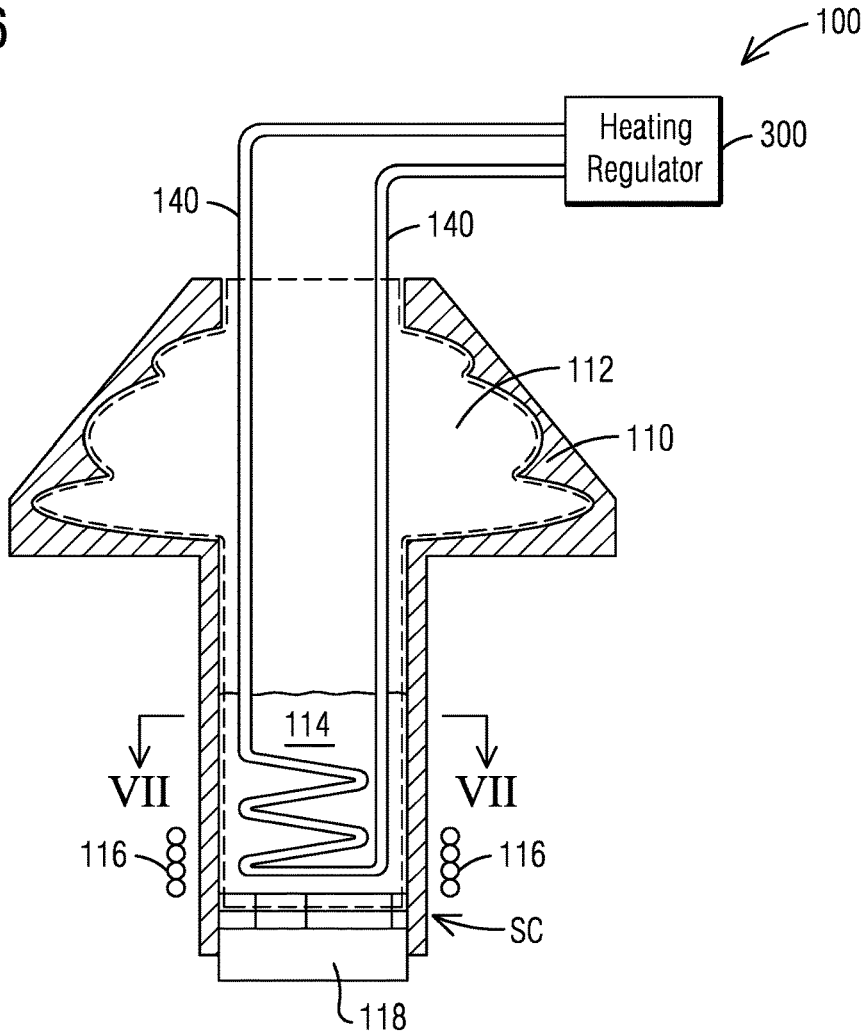
FIG. 6 is an exemplary schematic view of yet a further embodiment of the system of FIG. 1, in accordance with the disclosure provided herein.

With reference now to FIG. 6, the heating regulator 300 may be operatively connected to one or more of the COH 140 for controlling the temperature of the heating wire 144. In one exemplary embodiment, the heating regulator 300 may be an electrical power supply 300 operatively connected to the COH 140 for changing the electrical current and temperature, e.g., via the controller 101, of the heating wire 144.

It yet a further embodiment of the system 100, a combination of COC 130 and COH 140 may be used to further enhance steering and managing of grain growth from solidifying alloys. The direction and speed of solidification may be controlled, e.g., via the controller, by adjustment of the number of elements arranged in the superalloy 114 and by adjustment of their respective cooling and heating parameters, e.g., their temperatures. The refractory conduits 120 (130, 140) may further be moved in any number of directions within the superalloy 114 to further control grain growth. In a further embodiment, the shape of any of the refractory conduits 120 may be non-circular, and may comprise multiple conduits or layers within the outer sleeve material. In yet a further embodiment, coiled or woven arrays of refractory conduits may be applied for management of grain growth. Additionally, one or more fins (not shown) may be attached to the refractory conduits 120, e.g., the outer sleeve, for enhanced heat transfer.

Figure 8:
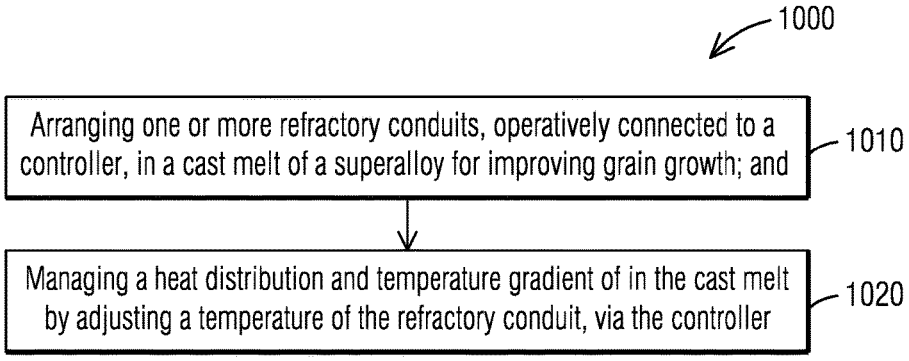
FIG. 8 is an exemplary flowchart for an embodiment of a method of improving grain growth in a cast melt of a superalloy, in accordance with the disclosure provided herein.

With continued reference to the figures and now FIG. 8, a flowchart for an embodiment of a method 1000 of improving grain growth in a cast melt 114, e.g., of a superalloy, is provided. The improved grain growth process may by pouring the cast melt 114 into the mold 110 for, e.g., a turbine blade. Once the melt 114 is in the mold 110, the method 1000 may include the step of selectively positioning/arranging one or more of refractory conduits of heating elements 140 and/or cooling elements 130 in the cast melt 114 to manage heat distribution and temperature gradient (1010).

It should be appreciated that the refractory conduits 120 may be arranged prior to the pouring of the cast melt 114 into the mold 110. It should further be appreciated that the temperature of the conduits 120 at the time of arranging/depositing into the melt 114 should be such that no solidification around the conduits 120 occurs. For example, the temperature of the conduits/elements 120 may be approximate or equal to the temperature of the superalloy 114 so that solidification around the element 120 does not occur upon being deposited in the superalloy 114. Further in this step, and depending on the desired direction of grain grown the conduits 120 may be selectively placed, e.g., uniformly, in a vertical or horizontal arrangement.

Upon arranging the conduits 120, the method 1000 comprises the step of adjusting a temperature and movement of the heating/cooling elements to induce a temperature gradient (1020). In this step, e.g., the electrical current (e.g., of the heating wire 144 in a heating element 140) and/or the flow rate (e.g., of the coolant 134 in a cooling element 130) may be adjusted, e.g., via the controller under the control of a control application. For example, as described herein, the tungsten 144 encapsulated within the outer sleeve 142 of the heating element 140 may be heated, via the controller 101, to a temperature above the melt temperature of the melt 114, but below the melting temperature of the outer sleeve 142 to control the direction and speed of solidification. In an embodiment where the conduit 120 is a cooling element 130, the coolant 134, e.g., sodium potassium, may be circulated, via the controller 101, through the alumina tubing 132 at, e.g., 700° C., which may cause the superalloy 114 to cool, thereby inducing the temperature gradient.

Thereafter, the coolant 134 may be returned to the reservoir of coolant, e.g., via a heat exchanger operable to recover the coolant 134 to its initial temperature for further circulation through the cooling element 130 in the melt 114. It should be appreciated that the controller 101 may provide a means for monitoring the temperature of the coolant 134 in the cooling element 130, e.g., via one or more sensors (not shown) operatively connected to the cooling element 130, and for monitoring the joules or current in a resistance heating in the heating wire 144, via one or more sensors or other means known to persons of ordinary skill. It should further be appreciated that the movement may further be controlled, e.g., by controlling the rate of application, which may include the pour rate and/or the pour temperature of the melt 114. These rates may be also be monitored via the controller 101, and using, e.g., the pyrometer to look at the surface of the melt 114.

While specific embodiments have been described in detail, those with ordinary skill in the art will appreciate that various modifications and alternative to those details could be developed in light of the overall teachings of the disclosure. For example, elements described in association with different embodiments may be combined. Accordingly, the particular arrangements disclosed are meant to be illustrative only and should not be construed as limiting the scope of the claims or disclosure, which are to be given the full breadth of the appended claims, and any and all equivalents thereof. It should be noted that the terms "comprising", "including", and "having", are open-ended and does not exclude other elements or steps and the use of articles "a" or "an" does not exclude a plurality. Additionally, the steps of various methods disclosed herein are not required to be performed in the particular order recited, unless otherwise expressly stated.

We claim:

1. A system for managing grain growth in a superalloy melt for a turbomachine part comprising:

a mold defining a shape of the turbomachine part and having the superalloy melt deposited therein;

one or more refractory conduits selectively arranged in a cavity of the mold;

a controller operatively connected to the one or more refractory conduits, and configured to adjust an electrical current and/or a flow-rate of the refractory conduit to induce a temperature gradient.

2. The system of claim 1 further comprising: one or more hot zones arranged proximate to the mold for promoting maximum temperature gradient along an axis of the turbomachine part.

3. The system of claim 1 further comprising: one or more cold zones arranged proximate to the mold and one or more hot zones arranged proximate to the mold for promoting maximum temperature gradient along an axis of the turbomachine part.

4. The system of claim 1, wherein the temperature of the refractory conduit positioned in the superalloy melt is equal to the temperature of the superalloy melt.

5. The system of claim 1, wherein the refractory conduits are selectively arranged in the superalloy melt in one of a horizontal or vertical arrangement.

6. The system of claim 1, wherein at least a portion of the refractory conduits are heating elements selectively arranged in a vertical arrangement.

7. The system of claim 6, wherein each heating element includes an outer sleeve encapsulating a heating wire.

8. The system of claim 7, wherein the outer sleeve includes refractory material selected from the group consisting of alumina, mullite, zirconia, and zirconia partially stabilized with magnesia, yttria, or silica, and wherein the heating wire is tungsten.

9. The system of claim 1, wherein at least a portion of the refractory conduits are cooling elements selectively arranged in the horizontal arrangement.

10. The system of claim 9, wherein the cooling element includes an outer sleeve encapsulating a coolant.

11. The system of claim 10, wherein the outer sleeve comprises refractory materials selected from the group consisting of alumina, mullite, zirconia, and zirconia partially stabilized with magnesia, yttria, or silica.

12. The system of claim 11, wherein the coolant is sodium potassium with a weight percent of about 23 percent sodium and 77 percent potassium.

13. The system of claim 1, wherein a first portion of refractory conduits within the superalloy melt are arranged in a vertical orientation and a second portion of refractory conduits are arranged in a horizontal orientation.

14. The system of claim 13, wherein one of the first portion of refractory conduits and the second portion of refractory conduits are heated and the other of the first portion of refractory conduits and the second portion of refractory conduits are cooled to induce a temperature gradient within the superalloy melt.

15. The system of claim 14, wherein the first portion of refractory conduits comprises an alumina sleeve encapsulating a heating wire and the second portion of refractory conduits comprises an alumina sleeve encapsulating a coolant.

* * * * *